US007894753B2

(12) United States Patent
Kasahara et al.

(10) Patent No.: US 7,894,753 B2
(45) Date of Patent: Feb. 22, 2011

(54) DEVELOPER CONTAINER INCLUDING MOUTH MEMBER AND IMAGE FORMING APPARATUS INCLUDING THE SAME

(75) Inventors: Nobuo Kasahara, Kanagawa (JP); Nobuo Iwata, Kanagawa (JP); Satoshi Muramatsu, Tokyo (JP); Junichi Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/871,516

(22) Filed: Oct. 12, 2007

(65) Prior Publication Data

US 2008/0038019 A1 Feb. 14, 2008

Related U.S. Application Data

(63) Continuation of application No. 10/441,105, filed on May 20, 2003, now Pat. No. 7,542,703.

(30) Foreign Application Priority Data

May 20, 2002 (JP) ..... 2002-144816
May 24, 2002 (JP) ..... 2002-150998

(51) Int. Cl.
*G03G 15/08* (2006.01)

(52) U.S. Cl. ..... 399/262; 399/260

(58) Field of Classification Search ..... 399/262, 399/260, 258

See application file for complete search history.

(56) References Cited

U.S. PATENT DOCUMENTS 4,775,874 A 10/1988 Buyukguclu
4,833,501 A 5/1989 Buyukguclu
5,184,181 A 2/1993 Kurando et al.
5,329,340 A * 7/1994 Fukuchi et al. ..... 399/254
5,441,177 A 8/1995 Yanagisawa
5,491,542 A 2/1996 Nagashima et al.
5,515,143 A 5/1996 Shiotani
5,648,840 A 7/1997 Ikunami et al.
5,819,144 A 10/1998 Okada et al.

(Continued)

FOREIGN PATENT DOCUMENTS

CN 1107587 A 8/1995

(Continued)

OTHER PUBLICATIONS

U.S. Appl. No. 09/907,326, filed Jul. 17, 2001 published on Nov. 15, 2001 with Publication No. US 2001/0041083 A1.

(Continued)

*Primary Examiner*—Quana M Grainger
(74) *Attorney, Agent, or Firm*—Oblon, Spivak, McClelland, Maier & Neustadt, L.L.P.

(57) ABSTRACT

A developing device of the present invention develops a latent image formed on an image carrier with a two-ingredient type developer made up of toner and carrier. The developing device includes a storing member for storing a fresh developer to be replenished. A conveying device conveys the fresh developer from the storing member to a case, which stores the two-ingredient type developer to be deposited on the image carrier, while fluidizing the fresh developer. An excess developer discharging portion is configured to discharge excess part of the two-ingredient type developer to the outside. The developer storing member is implemented as an at least partly flexible bag.

28 Claims, 15 Drawing Sheets

U.S. PATENT DOCUMENTS

| | | | | |
|---|---|---|---|---|
| 5,867,757 | A | 2/1999 | Okazaki et al. | |
| 5,875,380 | A | 2/1999 | Iwata et al. | |
| 5,890,040 | A | 3/1999 | Matsuoka et al. | |
| 5,950,055 | A * | 9/1999 | Yahata et al. | 399/252 |
| 5,953,567 | A | 9/1999 | Muramatsu et al. | |
| 5,987,298 | A | 11/1999 | Muramatsu et al. | |
| 6,104,900 | A | 8/2000 | Ishikawa et al. | |
| 6,112,046 | A | 8/2000 | Suzuki et al. | |
| 6,125,243 | A | 9/2000 | Shoji et al. | |
| 6,163,669 | A | 12/2000 | Aoki et al. | |
| 6,169,864 | B1 | 1/2001 | Baxendell et al. | |
| 6,185,401 | B1 | 2/2001 | Kanamori et al. | |
| 6,201,941 | B1 * | 3/2001 | Kasahara et al. | 399/258 |
| 6,256,470 | B1 | 7/2001 | Taniyama et al. | |
| 6,282,396 | B1 | 8/2001 | Iwata et al. | |
| 6,292,644 | B1 | 9/2001 | Goto et al. | |
| 6,295,437 | B1 | 9/2001 | Hodoshima et al. | |
| 6,298,208 | B1 | 10/2001 | Kawamura et al. | |
| 6,381,435 | B2 | 4/2002 | Shinohara et al. | |
| 6,393,241 | B1 | 5/2002 | Matsumoto et al. | |
| 6,442,355 | B2 | 8/2002 | Hasegawa et al. | |
| 6,466,749 | B1 | 10/2002 | O'Brien | |
| 6,480,689 | B2 | 11/2002 | Jacobs | |
| 6,507,720 | B2 | 1/2003 | Kabumoto et al. | |
| 6,526,243 | B2 | 2/2003 | Kim et al. | |
| 6,526,246 | B2 | 2/2003 | Iwata et al. | |
| 6,542,707 | B2 | 4/2003 | Muramatsu et al. | |
| 6,587,661 | B1 | 7/2003 | Shimmura et al. | |
| 6,608,983 | B2 * | 8/2003 | Terazawa et al. | 399/258 |
| 6,628,915 | B2 | 9/2003 | Muramatsu et al. | |
| 6,678,492 | B1 * | 1/2004 | Terazawa et al. | 399/258 |
| 6,785,497 | B1 | 8/2004 | Hasebe | |
| 6,795,660 | B2 | 9/2004 | Yugeta et al. | |
| D500,076 | S | 12/2004 | Takuwa | |
| 6,871,034 | B2 | 3/2005 | Muramatsu et al. | |
| 6,882,817 | B2 | 4/2005 | Kita | |
| 6,973,283 | B2 * | 12/2005 | Sato et al. | 399/303 |
| 7,085,522 | B2 | 8/2006 | Muramatsu et al. | |
| 7,088,945 | B2 | 8/2006 | Matsumoto et al. | |
| 7,130,558 | B2 | 10/2006 | Matsumoto et al. | |
| D532,037 | S | 11/2006 | Tsuda et al. | |
| 7,133,629 | B2 | 11/2006 | Kita | |
| 7,184,691 | B2 | 2/2007 | Kita et al. | |
| 7,209,689 | B2 | 4/2007 | Matsumoto et al. | |
| 7,221,891 | B2 | 5/2007 | Matsumoto et al. | |
| 7,245,852 | B2 | 7/2007 | Takuwa | |
| 7,248,824 | B2 | 7/2007 | Takami | |
| 7,257,348 | B2 | 8/2007 | Matsumoto et al. | |
| 7,277,664 | B2 | 10/2007 | Katsuyama et al. | |
| 7,313,349 | B2 | 12/2007 | Suzuki et al. | |
| 7,346,299 | B2 | 3/2008 | Muramatsu et al. | |
| 7,389,071 | B2 | 6/2008 | Katsuyama et al. | |
| 7,406,278 | B2 | 7/2008 | Katsuyama et al. | |
| 7,426,362 | B2 | 9/2008 | Takami | |
| 7,450,891 | B2 | 11/2008 | Muramatsu et al. | |
| 7,480,476 | B2 | 1/2009 | Hosokawa et al. | |
| 7,536,139 | B2 | 5/2009 | Katsuyama et al. | |
| 7,542,703 | B2 | 6/2009 | Kasahara et al. | |
| 7,577,379 | B2 | 8/2009 | Kita et al. | |
| D599,845 | S | 9/2009 | Kurenuma et al. | |
| 7,590,374 | B2 | 9/2009 | Takami | |
| 7,593,674 | B2 | 9/2009 | Matsumoto et al. | |
| D602,985 | S | 10/2009 | Yoshizawa | |
| 7,603,054 | B2 | 10/2009 | Katsuyama et al. | |
| 2002/0031375 | A1 * | 3/2002 | Hattori et al. | 399/262 |
| 2002/0114646 | A1 | 8/2002 | Sudo et al. | |
| 2003/0002884 | A1 | 1/2003 | Yamada et al. | |
| 2003/0081968 | A1 | 5/2003 | Minagawa | |
| 2003/0081969 | A1 * | 5/2003 | Muramatsu et al. | 399/258 |
| 2003/0198488 | A1 | 10/2003 | Wang et al. | |
| 2003/0202823 | A1 | 10/2003 | Tamura | |
| 2004/0184841 | A1 | 9/2004 | Tsuda et al. | |
| 2004/0197121 | A1 | 10/2004 | Muramatsu et al. | |
| 2004/0228641 | A1 | 11/2004 | Rommelmann et al. | |
| 2005/0254841 | A1 | 11/2005 | Tomitaka | |
| 2005/0281592 | A1 | 12/2005 | Muramatsu et al. | |
| 2007/0077098 | A1 | 4/2007 | Katsuyama et al. | |
| 2007/0122204 | A1 | 5/2007 | Kita | |
| 2007/0122205 | A1 | 5/2007 | Taguchi et al. | |
| 2007/0140747 | A1 | 6/2007 | Kita et al. | |
| 2007/0147900 | A1 | 6/2007 | Taguchi et al. | |
| 2007/0147902 | A1 | 6/2007 | Taguchi et al. | |
| 2007/0154243 | A1 | 7/2007 | Taguchi et al. | |
| 2007/0154244 | A1 | 7/2007 | Taguchi et al. | |
| 2007/0160393 | A1 | 7/2007 | Taguchi et al. | |
| 2007/0160394 | A1 | 7/2007 | Taguchi et al. | |
| 2007/0177886 | A1 | 8/2007 | Taguchi et al. | |
| 2007/0189813 | A1 | 8/2007 | Matsumoto et al. | |
| 2007/0212119 | A1 | 9/2007 | Kurenuma et al. | |
| 2008/0063435 | A1 | 3/2008 | Takami | |
| 2008/0069596 | A1 | 3/2008 | Katsuyama et al. | |
| 2008/0310884 | A1 | 12/2008 | Matsumoto et al. | |

FOREIGN PATENT DOCUMENTS

| | | | | |
|---|---|---|---|---|
| CN | 2205817 | Y | | 8/1995 |
| JP | 59100471 | A | | 6/1984 |
| JP | 03011377 | A | | 1/1991 |
| JP | 4-66984 | | | 3/1992 |
| JP | 05-107918 | | | 4/1993 |
| JP | 05303279 | A | | 11/1993 |
| JP | 6-149047 | | | 5/1994 |
| JP | 06242683 | A | | 9/1994 |
| JP | 06274031 | A | | 9/1994 |
| JP | 06301289 | A | * | 10/1994 |
| JP | 06-345113 | | | 12/1994 |
| JP | 7-234575 | | | 9/1995 |
| JP | 08-292633 | | | 11/1996 |
| JP | 09043986 | A | | 2/1997 |
| JP | 09106156 | A | | 4/1997 |
| JP | 9-166912 | | | 6/1997 |
| JP | 9-204105 | | | 8/1997 |
| JP | 09244379 | A | | 9/1997 |
| JP | 410063075 | A | | 3/1998 |
| JP | 11119536 | A | | 4/1999 |
| JP | 11-231748 | | | 8/1999 |
| JP | 11265121 | A | * | 9/1999 |
| JP | 11-272075 | | | 10/1999 |
| JP | 2000147879 | A | | 5/2000 |
| JP | 2000-172060 | | | 6/2000 |
| JP | 2000-356899 | | | 12/2000 |
| JP | 2001228690 | A | | 8/2001 |
| JP | 2001-265100 | | | 9/2001 |
| JP | 2001-281976 | | | 10/2001 |
| JP | 2001315851 | A | | 11/2001 |
| JP | 2002-6690 | | | 1/2002 |
| JP | 2002002833 | A | | 1/2002 |
| JP | 2002-72645 | | | 3/2002 |
| JP | 2002214894 | A | | 7/2002 |
| JP | 2003215903 | A | | 7/2003 |

OTHER PUBLICATIONS

U.S. Appl. No. 12/256,998, filed Oct. 23, 2008, Iwata et al.

* cited by examiner

DEVELOPER CONTAINER INCLUDING MOUTH MEMBER AND IMAGE FORMING APPARATUS INCLUDING THE SAME

CROSS REFERENCE TO RELATED APPLICATIONS

This application is a continuation of U.S. application Ser. No. 10/441,105, filed on May 20, 2003 now U.S. Pat. No. 7,542,703, and is based upon and claims the benefit of priority from the prior Japanese Patent Application Nos. 2002-144816 filed on May 20, 2002, and 2002-150998 filed on May 24, 2002, the entire contents of each of which are incorporated herein by reference.

BACKGROUND OF THE INVENTION

1. Field of the Invention

The present relates to a developing device using a two-ingredient type developer and an image forming apparatus including the same.

2. Description of the Background Art

It is a common practice with a copier, facsimile apparatus, printer or similar image forming apparatus to develop a latent image formed on a photoconductive element or image carrier with toner or similar developer. A two-ingredient type developer made up of toner and carrier is one of developers customarily used for development. The prerequisite with development using the two-ingredient type developer is that fresh toner be replenished in accordance with consumption in order to maintain the toner content of the developer constant. Various schemes have heretofore been proposed for meeting this prerequisite, as will be described hereinafter.

Japanese Patent Laid-Open Publication Nos. 7-219324, 7-219329 and 9-15957, for example, disclose a toner bottle, toner tank or similar hard toner container storing fresh toner and located in the toner replenishing section of a developing device and an arrangement for delivering the toner from the toner container to a developing case by suction or vacuum. Japanese Patent Laid-Open Publication Nos. 11-282238, 12-47464, 12-14789, 12-351445 and 12-356898, for example, teach toner replenishment using a bag as a toner container. Japanese Patent Laid-Open Publication No. 9-244372, for example, proposes a mechanism in which a toner container performs asymmetric reciprocating movement so as to cause toner to flow out via an outlet formed in the bottom of the container due to the resulting vibration. Japanese Patent Laid-Open Publication Nos. 7-20701, 7-20703 and 7-114260, for example, each disclose a toner container located in the vicinity of a developing case and configured to replenish fresh toner to the case mainly by gravity.

While fresh toner is replenished in accordance with consumption in order to maintain the toner content of the developer constant, the carrier is, in many cases, used without regard to the replenishment of fresh carrier and therefore deteriorated due to repeated agitation. The deterioration of the carrier includes fatigue ascribable to the wear of the carrier itself, damage to a coating layer used to increase the charging ability, and toner filming, i.e., adhesion of toner to the carrier. The deterioration of the carrier is apt to lower the charging ability of toner.

To obviate the fall of the charging ability of toner ascribable to the deterioration of carrier, there has been proposed a developer replacement system called a trickle development system. The trickle development system replenishes a fresh carrier independently of the replenishment of toner while discharging the resulting excess part of a developer, thereby replacing the developer containing deteriorated carrier with a fresh developer.

As for the trickle development system, Japanese Patent Publication No. 2-21591 and Japanese Patent Laid-Open Publication Nos. 9-166912, 9-218575 and 9-244376, for example, each propose to replenish a toner and carrier mixture or so-called premixed developer. Japanese Patent Laid-Open Publication No. 9-204105, 9-251235 and 9-269644, for example, each teach a system configured to replenish toner and carrier to a developing device individually while collecting excess part of the developer from a developing case. Japanese Patent Laid-Open Publication Nos. 10-63074 and 10-63075, for example, disclose a system configured to control the replenishment of toner in accordance with the consumption of toner, the replenishment of carrier in accordance with the amount of toner replenished, and the discharge of the developer. Japanese Patent Lad-Open Publication Nos. 7-234575 and 2001-194860, for example, each propose a system in which a single carrier replenishing section is shared by a plurality of developing devices. Japanese Patent Laid-Open Publication Nos. 11-143196 and 11-272075, for example, each disclose a system configured to feed toner and carrier to a developing case while controlling their mixture ratio.

However, the conventional constructions and systems described above have the following problems left unsolved. As for the replenishment of toner, a toner container is, in many cases, implemented as a hard bottle having a substantial volume. The number of such hard bottles that can be collected for a unit capacity is limited, resulting in high collection cost. Although a contractible bag-like toner container has been proposed, it lacks an implementation for delivering substantially the entire toner stored therein, so that much toner is left in the container and increases consumption cost.

Today, a screw auger is extensively used for conveying fresh toner tobe replenished. However, a screw auger must be configured integrally with or located in the vicinity of a developing device or a toner container due to its structure, complicating the entire structure and thereby increasing cost. Further, not only a portion to be maintained but also the entire subassembly must be dismounted. Such maintenance is difficult for the user to perform.

To replace a developer to be replenished, it has been customary to disassemble a developing device, remove a developer container, refill the container, and again assemble the developing device. Such replacement is difficult for the user to perform and, in many cases, relies on a service person, resulting in down-time and forcing the user to bear extra expense. Although the trickle development system reduces the frequency of replacement that needs the above procedure, it cannot solve the problems relating to collection and conveyance because a fresh toner container and a fresh carrier container themselves are the same as in the case of toner replenishment described above.

In the trickle development system, the mixture ratio of toner and carrier to be replenished remains constant. Therefore, when the developer is consumed in a large amount, e.g., when images with a large size or high density are continuously formed, the carrier is replenished along with the toner that is replenished in accordance with a change in toner content. Stated another way, the carrier is replaced with fresh carrier without regard to the life of the carrier present in the developer. This is wasteful and forces the user to bear high maintenance cost.

Conversely, when images with low density are continuously formed, the carrier is not replaced because the consumption of toner decreases. Consequently, the carrier of the developer is simply, repeatedly charged by agitation and continuously used even when it is deteriorated. Therefore, when the carrier is replaced on the basis of a change in the toner content of the developer, it is likely that the life of the carrier differs from the actual condition, resulting in wasteful replenishment, an increase in cost, and the fall of charging ability of toner. Particularly, when the toner is consumed little and when the life of carrier is determined to have ended, it is necessary, in the worst case, to replace the entire developer present in the developing device or the developing device itself, interrupting image formation over a long period of time.

SUMMARY OF THE INVENTION

It is an object of the present invention to provide a developing device of the type using a two-ingredient type developer and capable of replenishing a fresh developer without increasing collection cost or complicating the structure while reducing the amount of fresh developer to be left to thereby prevent replenishment cost from increasing, and an image forming apparatus including the same.

It is another object of the present invention to provide a developing device of the type using the trickle development system, which uses the above developer, and capable of replenishing toner and carrier without increasing collection cost or complicating the structure while accurately matching the replacement of the carrier to deterioration to thereby free the charging ability of toner from fall ascribable to the deterioration of carrier and maintain the toner content of a developer constant.

A developing device of the present invention develops a latent image formed on an image carrier with a two-ingredient type developer made up of toner and carrier. The developing device includes a storing member for storing a fresh developer to be replenished. A conveying device conveys the fresh developer from the storing member to a case, which stores the two-ingredient type developer to be deposited on the image carrier, while fluidizing the fresh developer. An excess developer discharging portion is configured to discharge excess part of the two-ingredient type developer to the outside. The developer storing member is implemented as an at least partly flexible bag.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Preferred embodiments of the present invention will be described with reference to the accompanying drawings hereinafter.

First Embodiment

Figure 1:
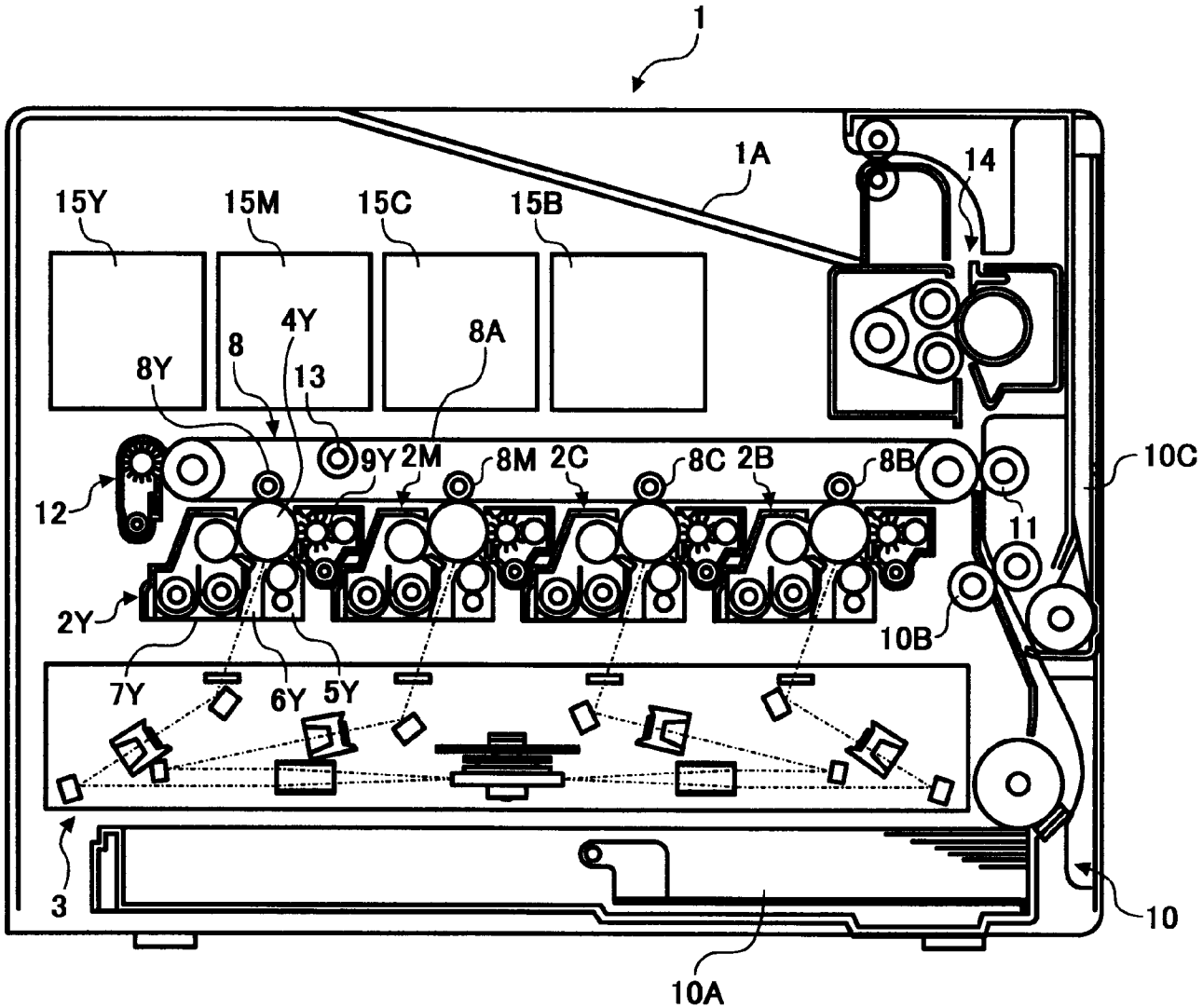
FIG. 1 shows an image forming apparatus to which a first embodiment of the developing device in accordance with the present invention is applied.

Referring to FIG. 1, an image forming apparatus including a developing device embodying the present invention is shown. While the image forming apparatus to be described is implemented as a tandem color printer capable of forming a plurality of images of different colors with developers complementary in color to color separation, the illustrative embodiment is similarly applicable to any other image forming apparatus, e.g., a copier, a facsimile apparatus or a printer.

As shown, the tandem color printer, generally 1, includes image forming units 2Y (yellow), 2M (magenta), 2C (cyan) and 2B (black) and an optical writing unit 3 positioned below the image forming units 2Y through 2B. Because the image forming units 2Y through 2B are identical in configuration except for color assigned thereto, the following description will concentrate on the image forming unit 2Y by way of example.

The image forming unit 2Y includes a photoconductive drum 4Y, which is a specific form of an image carrier. A charger 5Y, a light-incident position 6Y, a developing device 7Y, an image transferring device 8 and a cleaning device 9Y are sequentially arranged around the drum 4Y in the direction indicated by an arrow in FIG. 1 in order to execute an image forming process. A light beam issuing from the exposing unit 3 is incident to the light-incident position 6Y.

The developing device 7Y stores a two-ingredient type developer made up of toner grains and carrier grains; the toner-to-carrier mixture ratio is between 1.5 toner wt % and 5.0 toner wt %. As the developer is consumed by repeated development little by little, a fresh developer is replenished from a replenishing section, which will be described later, to thereby maintain the preselected toner content of the developer. In the illustrative embodiment, use is made of a premixed developer in which toner grains and carrier grains are mixed in a preselected ratio beforehand.

The image transferring device 8 includes a belt 8A movable in contact with the photoconductive drums of the image forming units 2Y through 2B. An image transfer roller 8Y faces the drum 4Y with the intermediary of the belt 8A and is capable of applying a bias for image transfer. In the illustrative embodiment, the image transferring device 8 sequentially transfers toner images of different colors formed on the drums of the image forming units 2Y through 2B to the belt 8A one above the other (primary image transfer) and then transfers the resulting composite color image from the belt 8A to a sheet or recording medium fed from a sheet feeding device 10 (secondary image transfer). For the secondary image transfer, a secondary image transferring device 11 is located at a secondary image transfer position and includes an image transfer roller.

The sheet feeding device 10 includes a sheet cassette 10A loaded with a stack of sheets and a registration roller pair 10B positioned on a sheet feed path. This sheet feed path joins a sheet feed path extending from a manual sheet feed tray 10C at the registration roller pair 10B. A cleaning device 12 and a discharging device 13 are assigned to the belt 8A.

The sheet carrying the composite toner image transferred thereto by the secondary image transfer is conveyed to a fixing device 14 and has the toner image fixed thereby. Thereafter, the sheet or print is driven out of the printer to a tray 1A.

Figure 2:
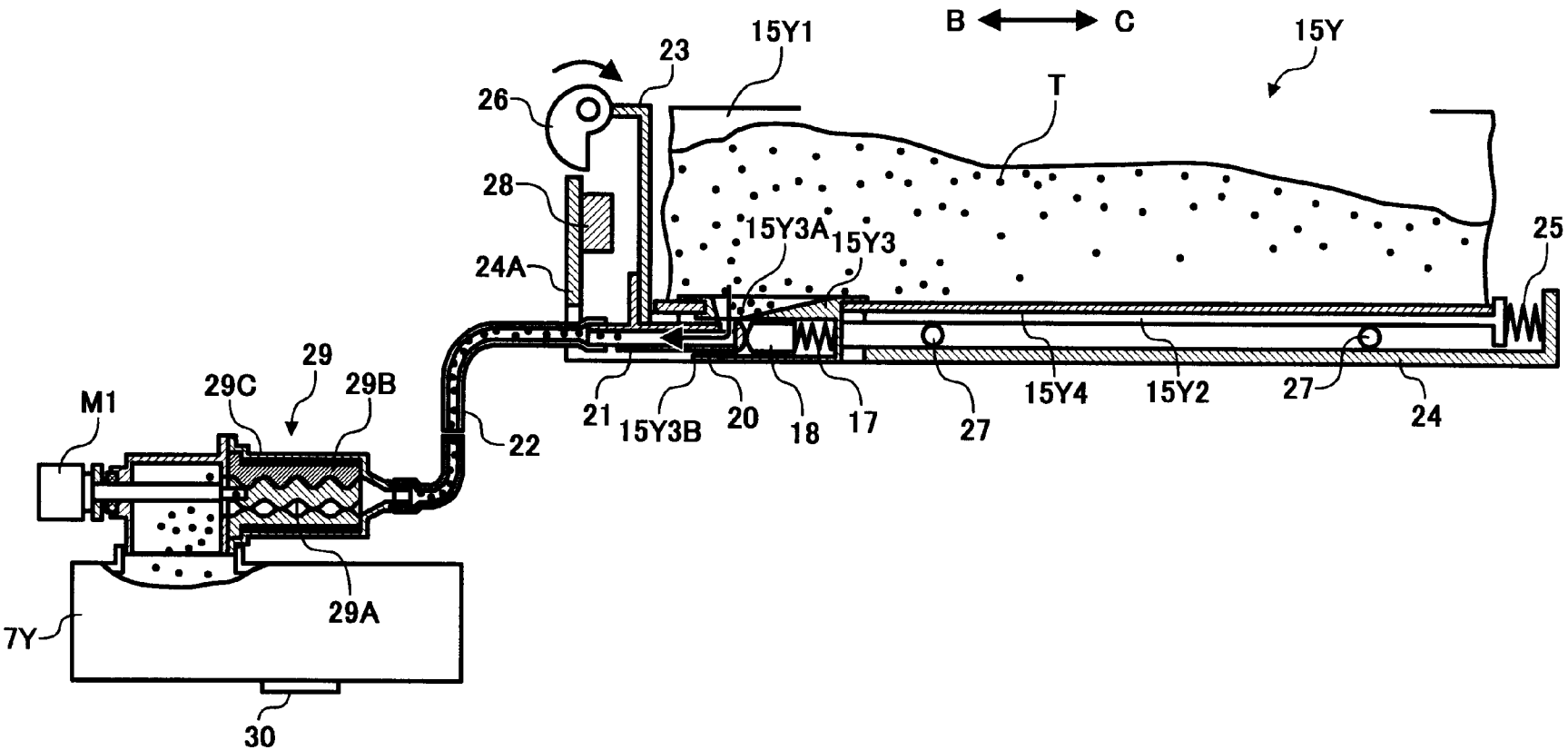
FIG. 2 shows a developer replenishing section included in the illustrative embodiment.
Figure 3:
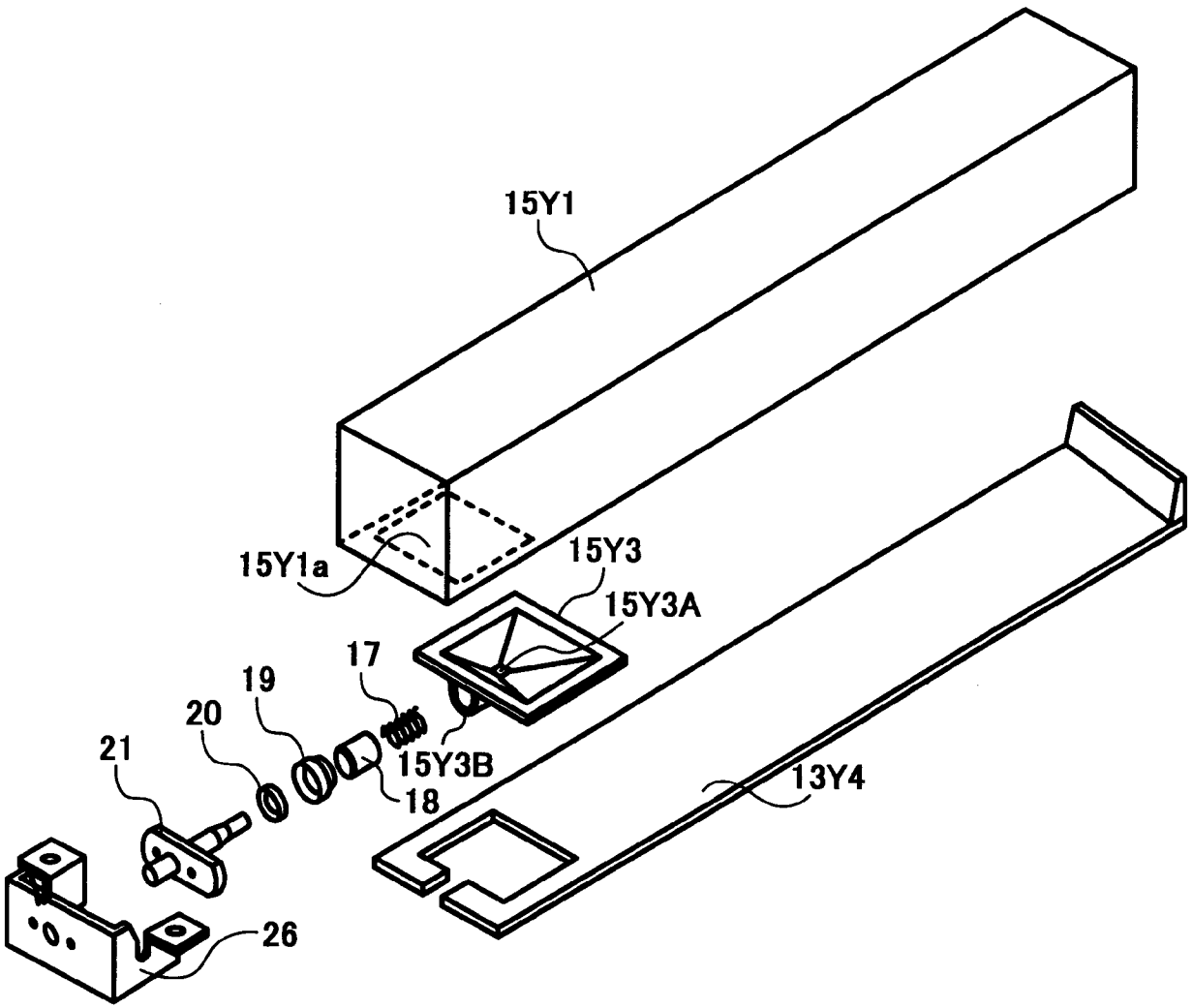
FIG. 3 is an exploded perspective view showing part of developer storing means included in the developer storing section.

Replenishing sections 15Y, 15M, 15C and 15B are arranged above the image forming units 2Y through 2B, and each stores a premixed developer of a particular color applicable to the trickle development system. The replenishing section 15Y, for example, replenishes a premixed developer containing yellow toner to the developing device 7Y. FIGS. 2 and 3 show the replenishing section 15Y in detail by way of example.

As shown in FIG. 2, the replenishing section 15Y includes a storing member or developer storing means 15Y1 that stores the premixed developer and is implemented as a flexible bag whose volume can decrease. A structural body 15Y2 is movable back and forth while being loaded with the storing member 15Y1. In the illustrative embodiment, when the toner-to-carrier mixture ratio, as measured in the developing device 7Y, is selected to be between 1.5 toner wt % and 5.0 toner wt %, the toner-to-carrier mixture ratio of the premixed developer is selected to fall between 70 toner wt % and 90 toner wt %.

As shown in FIGS. 2 and 3, the storing member or bag 15Y1 is constituted by a 50 μm to 300 μm thick, resin film or similar flexible member formed with an opening l5Y1*a*. A mouth member or receiver 15Y3 is adhered, welded or otherwise affixed to the edges of the opening 15Y1*a*. A bottom plate 15Y4 is constructed integrally with the storing member 15Y1 and formed of about 0.5 mm thick resin, which is thicker and more rigid than the storing member 15Y1. In this configuration, when the volume and therefore the height of the storing member 15Y1 decreases due to the consumption of the premix developer, it can be stacked together with a relatively large number of other storing members, promoting efficient collection. Further, the bottom plate 15Y4, which is relatively rigid, can be easily mounted to the structural body 15Y2. In addition, when the structural body 15Y2 moves back and forth, the bottom plate 15Y4 deforms little and does not obstruct the delivery of the premixed developer.

The mouth member or receiver 15Y3 includes a funnel-like bottom formed with an outlet 15Y3A. A tubular portion 15Y3B is below the outlet 15Y3A, extends horizontally, and has one end thereof closed. A coil spring or similar resilient member 17, a cap or plug 18, a seal holder 19 (see FIG. 3), a seal 20 and a nozzle 21 are sequentially disposed in the tubular portion 15Y3B in this order, as named from the closed end side. The tubular portion 15Y3B adjoins the storing member 15Y3. The resilient member 17, cap or plug 18, seal holder 19 and seal 20 are disposed in the tubular portion 15Y3B beforehand while the cap or plug 18 closes the outlet 15Y3A under the action of the resilient member 17. This condition is maintained with the head portion of the cap or plug 18 abutting against the seal holder 19. Therefore, the premixed developer does not leak from the storing member 15Y1 before the storing member 15Y1 with the bottom plate 15Y4 is mounted to the structural body 15Y2.

When the nozzle 21 is inserted into the tubular portion 15Y3B of the mouth member or receiver 15Y3, it is brought into fluid communication with the outlet 15Y3A, as shown in FIG. 2. A tube 22 is connected at one end to the end of the nozzle 21 opposite to the outlet 15Y3A and connected at the other end to a suction pump, which will be described later.

The nozzle 21 is connected to and movable together with a movable piece 23, which is constructed integrally with the structural body 15Y2. As shown in FIG. 2, the structural body 15Y2 with the movable piece 23 is constantly biased toward a support base 24 included in the replenishing section 15Y by a coil spring or similar resilient body 25. A cam 26 which one end of the movable piece 23 contacts limits the displacement of the structural body 15Y2.

More specifically, the cam 26 causes the structural body 15Y to move back and forth in directions B and C indicated by a double-headed arrow in FIG. 2. The cam 26 causes the structural body 15Y to move in the direction B when its smaller diameter portion contacts the movable piece 23 or causes it to move in the direction B when its large diameter portion contacts the piece 23. In FIG. 2, the smaller diameter portion of the cam 26 is shown as contacting the movable piece 23; in this condition, the outlet 15Y3A of the mouth member or receiver 15Y3 is communicated to the nozzle 21.

Rollers 27 are mounted on the bottom of the structural body 15Y2 and capable of rolling on the support base 24. A shoulder 14A extends out from the side of the support base 24 close to the cam 26 and is parallel to the movable piece 23. A shock-absorbing member 28 is fitted on the shoulder 24A for receiving the movable piece 23. More specifically, the shock-absorbing member 28 is formed of rubber, sponge or similar elastic material and allows the movable piece 23 to hit thereagainst under the action of the resilient member 25 when the smaller diameter portion of the cam 25 contacts the piece 23 after the larger diameter portion.

When the movable piece 23 hits against the shock-absorbing member 28, as stated above, a sharp change in acceleration occurs in the structural body 15Y2 with the result that a strong inertia force is generated in the toner present in the storing member 15Y1. The toner can therefore sharply move in one direction toward the mouth member or receiver 15Y3 shown in FIG. 2. This successfully loosens or fluidizes the toner.

The suction pump or toner conveying means 29 is a powder pump generally referred to as Morno pump or uniaxial, eccentric screw pump. The suction pump 29 is generally made up of an eccentric screw-like roller 29A formed of metal, resin or similar rigid material, a stator 29B formed of rubber and formed with two screw-threads in its inner periphery, and a stator 28B accommodating the roller 29A and stator 29B. When the rotor 19A rotates, suction pressure is generated within the suction pump 29 and sucks the premixed developer from the storing member 15Y1 via the tube 22.

As shown in FIG. 2, the developing device 7Y is connected to the outlet of the suction pump 29, so that the premixed developer sucked from the storing member 15Y1 can be introduced into the developing device 7Y.

Figure 4:
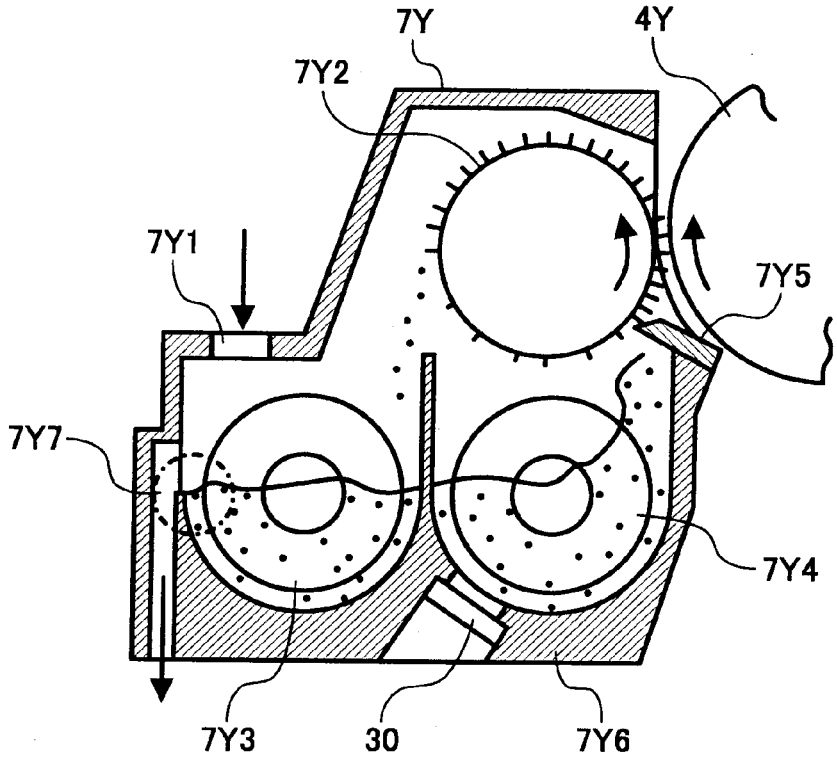
FIG. 4 is a section showing a specific configuration of the developing device of the illustrative embodiment.
Figure 5:
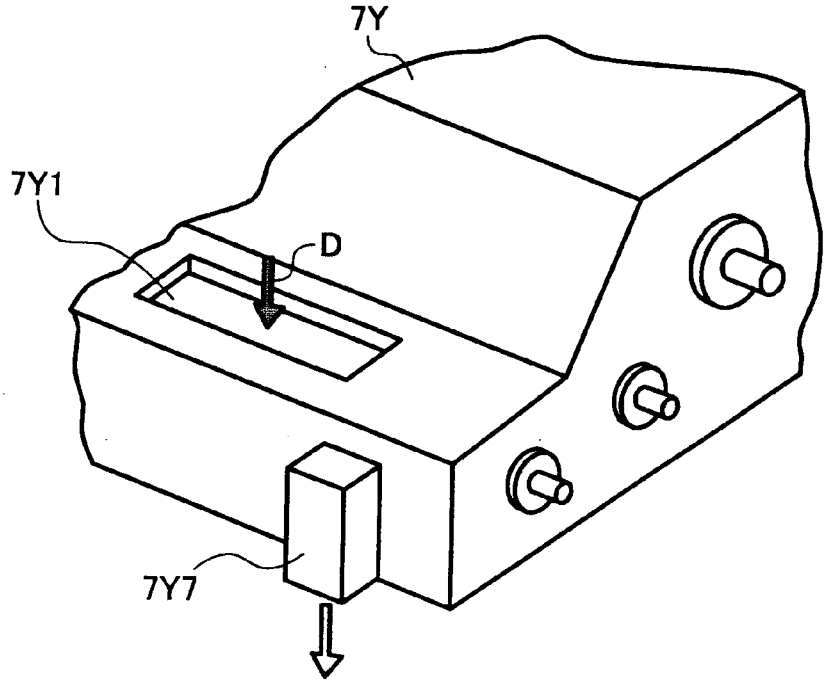
FIG. 5 is an external perspective view showing part of the developing device via which a replenished developer enters.
Figure 6A:
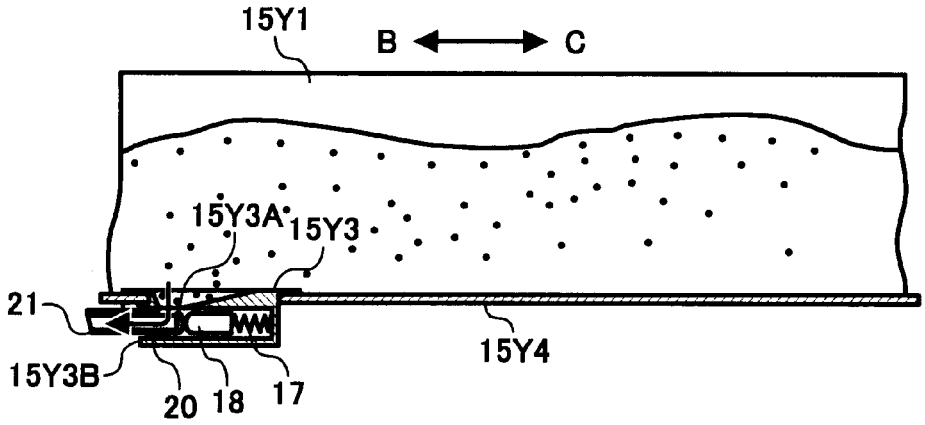
FIGS. 6A through 6D demonstrate the behavior of toner stored in a storing member.
Figure 6B:
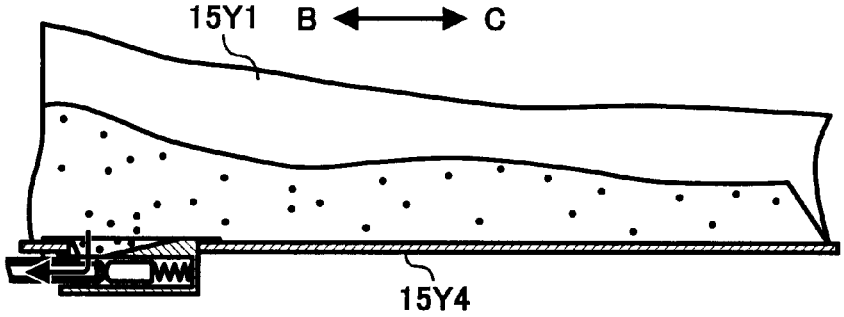
Figure 6C:
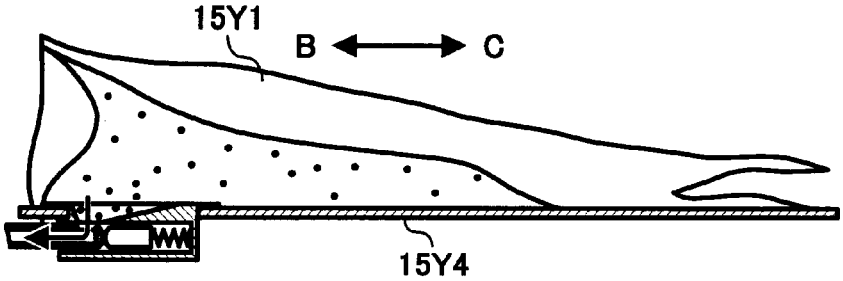
Figure 6D:
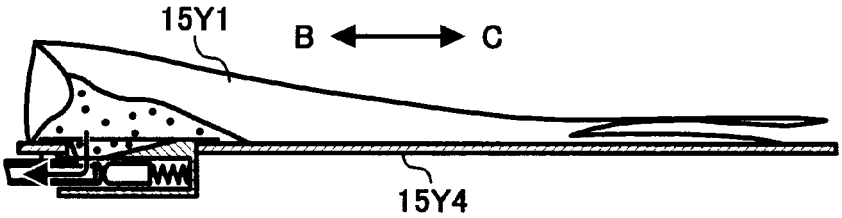

The developing device 7Y will be described more specifically with reference to FIGS. 4 and 5. As shown, an inlet 7Y1 is formed in the wall of the developing device 7Y facing the suction pump 29, so that the premixed developer, labeled D, can enter the developing device 7Y. A developing roller 7Y2 facing the drum 4Y, agitators or rollers 7Y3 and 7Y4 and a doctor blade 7Y5 are disposed in the developing device 7Y. The doctor blade 7Y5 determines the thickness of a developer layer to deposit on the developing roller 7Y2. A toner content sensor 30 is mounted on a case 7Y6 for sensing the toner content of the developer to be fed to the developing roller 7Y2.

In the illustrative embodiment, the toner-to-carrier mixture ratio in the case 7Y6 is selected to be 1.5 toner wt % to 5.0 toner wt %. The sensor 30 senses the toner content of the developer in terms of magnetic permeability. When the toner content of the developer is short, a drive motor Ml (see FIG. 2) assigned to the suction pump 29 and a drive motor assigned to the cam 26 are driven.

The case 7Y6 includes a dam 7Y7 for causing excess part of the developer to overflow the case 7Y6, thereby maintaining the amount of developer in the case 7Y6 constant. Part of the developer overflowed the case 7Y6 is delivered to a collecting portion not shown. If desired, the dam 7Y7 may be mounted to the outside of the developing device 7Y, as shown in FIG. 5.

FIGS. 6A through 6D demonstrate how the volume of the storing member 15Y1 decreases little by little as the premixed developer in the storing member 15Y1 is sucked by the suction pump 29. As shown, the premixed developer is delivered from the storing member 15Y1 little by little due to the suction pressure of the suction pump 29. When the movable piece 23 contacts the smaller diameter portion of the cam 26, a change in acceleration occurs in the structural body 15Y2 including the piece 23. The resulting intense inertia force causes the premixed developer to flow in one direction toward the mouth member or receiver 15Y3. Because the above inertia force occurs without regard to the amount of developer remaining in the storing member 15Y1, i.e., increases even when the amount is large, the developer can be stably delivered.

The premixed developer or similar material having fluidity needs higher acceleration than a rigid member, as determined by experiments. In light of this, in the illustrative embodiment, when the storing member 15Y1 stores 900 grams of premixed developer, acceleration of 40 m/sec$^2$, which is about four times as high as gravitational acceleration, or above is selected. Experiments showed that acceleration below 40 m/sec$^2$ failed to implement stable fluidity. Also, excessive acceleration made the impact force excessively intense and caused toner to cohere around and stop up the outlet, resulting in unstable replenishment. The upper limit of acceleration experimentally determined is 200 m/sec$^2$.

As the premixed developer flows out of the storing member 15Y1 due to repeated reciprocating movement of the structural body 15Y2, the volume of the storing member 15Y1 decreases due to the suction pressure of the suction pump 29. When substantially the entire developer is delivered from the storing member 15Y1, the above volume can be reduced to one-tenth to one-fifth of the original volume. The storing member 15Y1 with its volume thus reduced can be stacked together with alarge number of other storing members, promoting efficient collection and reducing a space for storage.

A suction force is intermittently generated in the replenishing section 15Y because the rotor and stator of the suction pump 29 mesh in different phases. The structural body 15Y2 is caused to move back and forth in synchronism with the generation of the suction force in the replenishing section 15Y, so that the premixed developer is delivered from the storing member 15Y1 when the suction force acts in the tube 22. It follows that when the outlet of the storing member 15Y1 is opened, only the developer is introduced into the tube 22 without any outside air mixed therewith. Outside air would vary the amount of delivery of the developer.

Why the toner-to-carrier mixture ratio of the premixed developer present in the storing member 15Y1 is selected to fall between 70 toner wt % and 90 toner wt % will be described hereinafter. As for the premixed developer, although a higher carrier content provides the developer with higher fluidity to thereby stabilize replenishment over a long time, it lowers the toner content and makes it necessary to increase the volume of the developer storing means in order to replenish a sufficient amount of toner, resulting in an increase in the space for accommodating the developer storing means. Moreover, when the carrier content is increased, the carrier is apt to wear the structural elements of the suction pump or conveying means 29, particularly the stator formed of rubber, reducing the life of the pump 29 and adversely effecting a head due to an increase in conveying distance and carrier mass.

Second Embodiment

Figure 7:
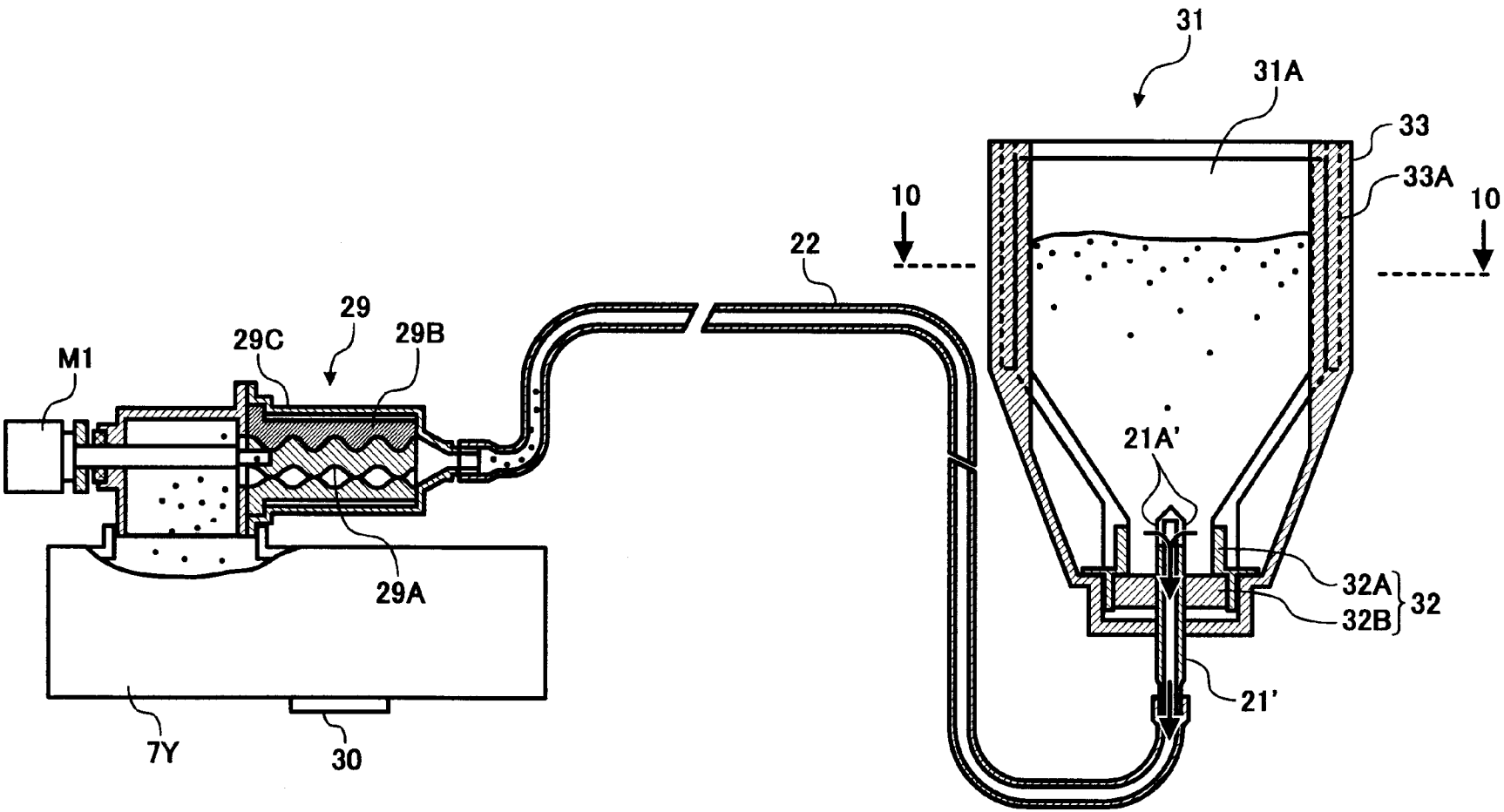
FIG. 7 shows a developer replenishing section included in a second embodiment of the developing device in accordance with the present invention.

An alternative embodiment of the present invention will be described with reference to FIG. 7. The illustrative embodiment has a unique configuration for promoting the deformation of the developer storing means when its volume decreases. In FIG. 7, structural elements identical with the structural elements shown in FIG. 2 are designated by identical reference numerals and will not be described specifically in order to avoid redundancy.

As shown, a nozzle 21' is connected to the end of the tube 22 remote from the suction pump 29 and inserted into developer storing means 31. In the illustrative embodiment, the developer storing means 31 is positioned upright, so that the nozzle 21' is inserted into the storing means 31 upward via a mouth member or receiver that will be described later specifically. The nozzle 21' is therefore formed with, in its tip portion, a plurality of inlets 21A' spaced from each other in the circumferential direction.

The developer storing means 31 includes a storing member or bag 31A formed of polyethylene, nylon or similar soft material and provided with a wall thickness of 60 μm to 200 μm. More specifically, the storing member 31A is implemented by one or more sheets or films formed of the above resin and stacked together.

Figure 8:
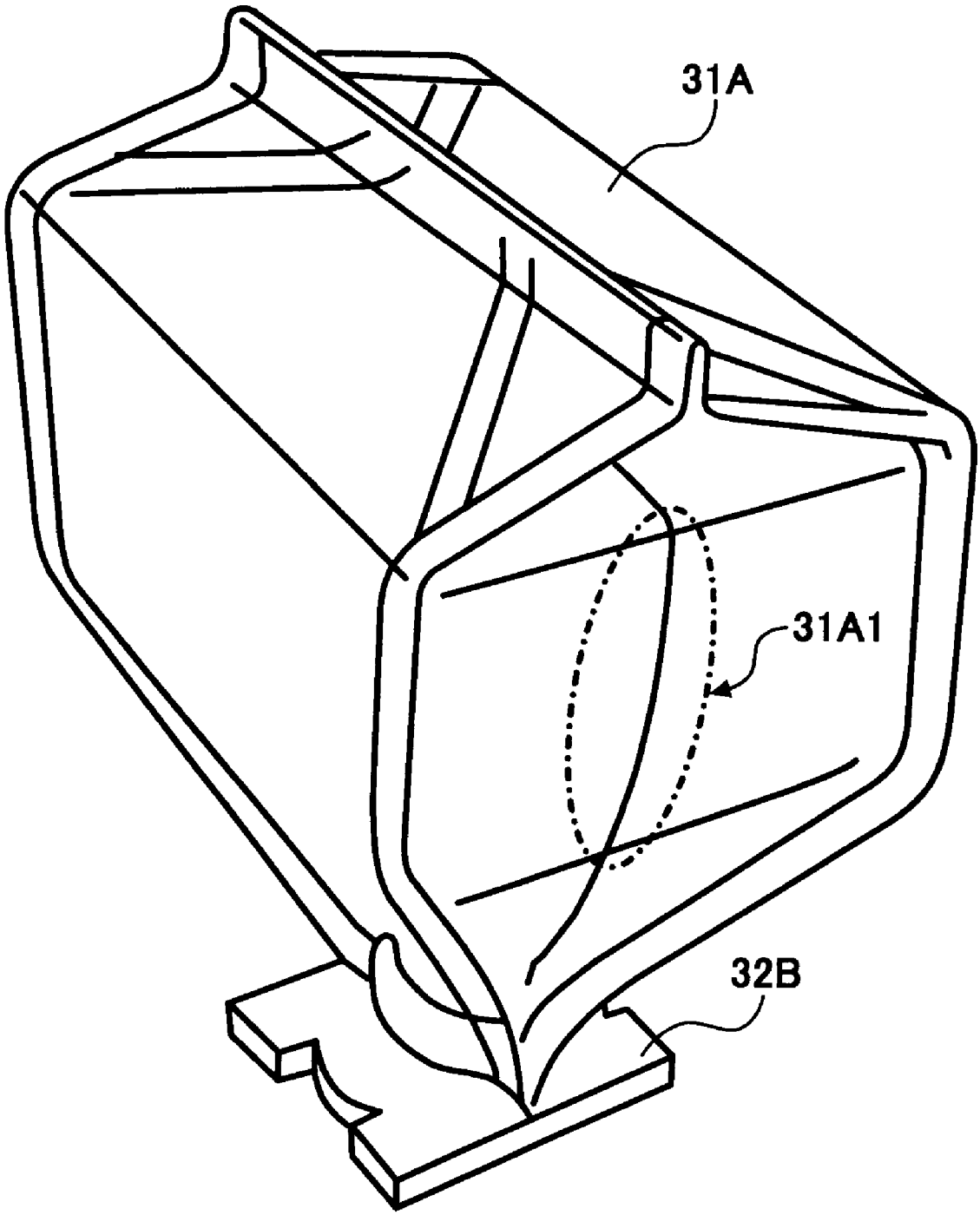
FIG. 8 is a perspective view showing developer storing means included in the developer storing section of the second embodiment.
Figure 9:
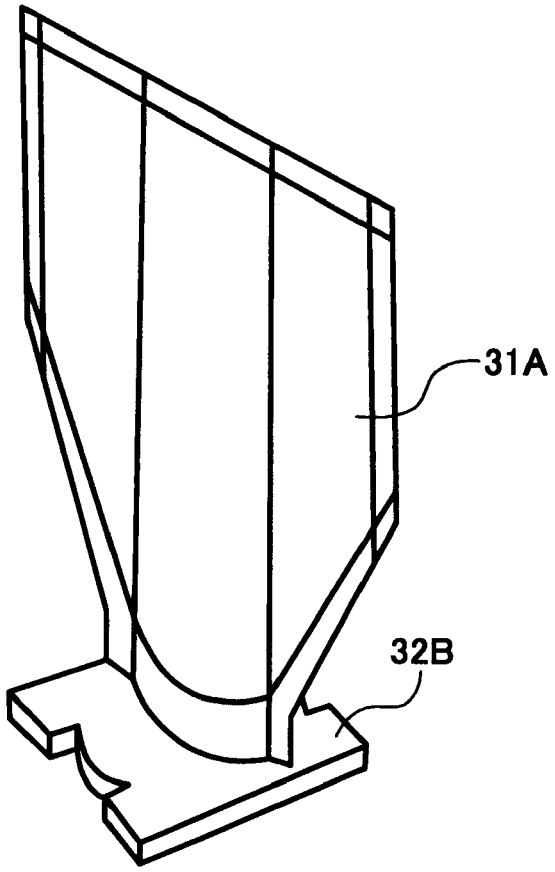
FIG. 9 is a perspective view showing the developer storing means in a contracted position.

FIG. 8 shows a specific configuration of the storing member 31A. As shown, four sheets are combined and have their one edge connected together by heat, constituting a so-called gazette type of container that can expand and contract. An inward fold 31A1 is formed in part of the outer periphery of the storing member 31A. When the storing member 31A contracts, it bends inward along the fold 31A1 and can therefore be folded up. FIG. 8 shows the storing member 31A in an expanded or full position filled with the premix developer. FIG. 9 shows the storing means 31A in a contracted or empty position.

Referring again to FIG. 7, a mouth member or receiver 32 is fitted in the outlet of the storing member 31 and made up of resin casing 32A and a sponge or similar seal member 32B.

The case 32A is fitted in a holder 33 included in the replenishing section, allowing the nozzle 21' to be inserted into the mouth member or receiver 32. When the nozzle 21' is inserted into the mouth member or receiver 32, the seal 32B closely contacts the circumference of the nozzle 21' to thereby hermetically seal the inside of the storing member 31A.

Figure 10:
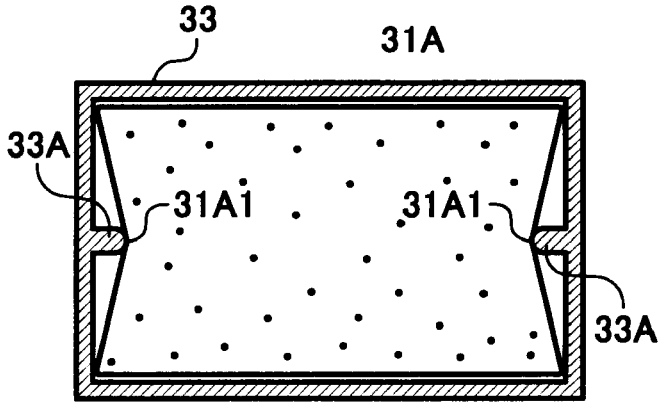
FIG. 10 is a section along line (10)-(10) of FIG. 7.

FIG. 10 is a section along line (10)-(10) of FIG. 7. As shown, the developer storing means 31 is mounted to a tray 33 formed with projections 33A that protrude inward toward the folds 31A1 of the storing member 31A. The projections 33A each bite into one of the folds 31A1 by 2 mm to 10 mm for thereby promoting bending of the fold 31A1.

In the illustrative embodiment, when the suction pump 29 is operated to replenish the premixed developer from the developer storing means 31 to the developing device, the developer can flow with higher fluidity than only toner because of the unique toner-to-carrier mixture ratio as in the previous embodiment.

When the suction pump 29 sucks the premixed developer from the storing member 31A, the volume of the storing member 31A decreases because it is hermetically sealed by the seal 32. At this instant, the projections 33A of the tray 33, maintaining the folds 31A1 easily foldable, causes the storingmember 31A to contract little by little to the folded position shown in FIG. 9. Consequently, the storing member 31A is neatly folded up with its portions facing each other contacting each other, i.e., without any twist particular to a conventional bag.

When the premixed developer stored in the storing member 31A is entirely consumed, the storing member 31A is neatly folded up, as shown in FIG. 9 and can therefore be collected together with a larger number of other storing members for a unit volume. Further, because the storing member 31A automatically folds to a desired configuration, it is not necessary to monitor how the storing member 31A collapses. Consequently, the storing member 31A is free from a residual space ascribable to twist and apt to catch the premixed developer and allows substantially the entire developer to be consumed, successfully reducing replenishment cost.

In the embodiment shown in FIG. 2 or 9, the premixed developer becomes ready to be replenished only if the tube 22 extending from the suction pump 29 is connected to the storing member via the nozzle 21 or 21', i.e., without regard to the position of the storing member. In addition, the premixed developer flies about little and therefore does not contaminate the inside of the apparatus.

Further, the illustrative embodiments, which convey the premixed developer by use of an air stream, obviate the cohesion of the developer and therefore toner blocking that is apt to occur when use is made of a screw auger. Toner blocking might increase power to be consumed by a drive source and might damage structural elements. Particularly, when the distance of conveyance is long, a plurality of screw augers must be arranged in consecutive stages, deteriorating the developer due to frictional heat and increasing the number of parts as well as maintenance cost.

As stated above, the first and second embodiments have various unprecedented advantages, as enumerated below.

(1) The storing member, which is implemented as a flexible bag, decreases in volume as the developer stored therein is consumed. The volume becomes minimum when the storing member runs out of the developer. The storing member so collapsed can be easily collected at a minimum of cost.

(2) The folds formed in the storing means allow the storing means to be folded up at the folds, so that the storing means can be automatically collapsed to the minimum volume when run out of toner.

(3) The tray, supporting the storing means, includes the lugs that provide the storing means with tendency to bend at the folds, allowing the storing means to surely contract when run out of toner.

(4) The storing means can decrease its volume on the basis of flexibility only if the suction pressure from the conveying means is used.

(5) When the toner-to-carrier mixture ratio used to develop a latent image is 1.5 toner wt % to 5.0 toner wt %, the toner-to-carrier mixture ratio of the premixed developer stored in the storing means is selected to fall between 70 toner wt % and 90 toner wt %. This obviates an increase in mass ascribable to an increase in the carrier for thereby preventing it from effecting the distance of conveyance and head in the conveying means.

(6) The storing means collapsed to the minimum volume can be easily collected at low cost.

Third Embodiment

Briefly, this embodiment differs from the previous embodiments in that it replenishes carrier grains independently of toner grains for thereby allowing used developers to be replaced with fresh developers. Structural elements identical with those shown in FIGS. 2 through 4 and 6A through 6D are designated by identical reference numerals and will not be described specifically in order to avoid redundancy.

Figure 11:
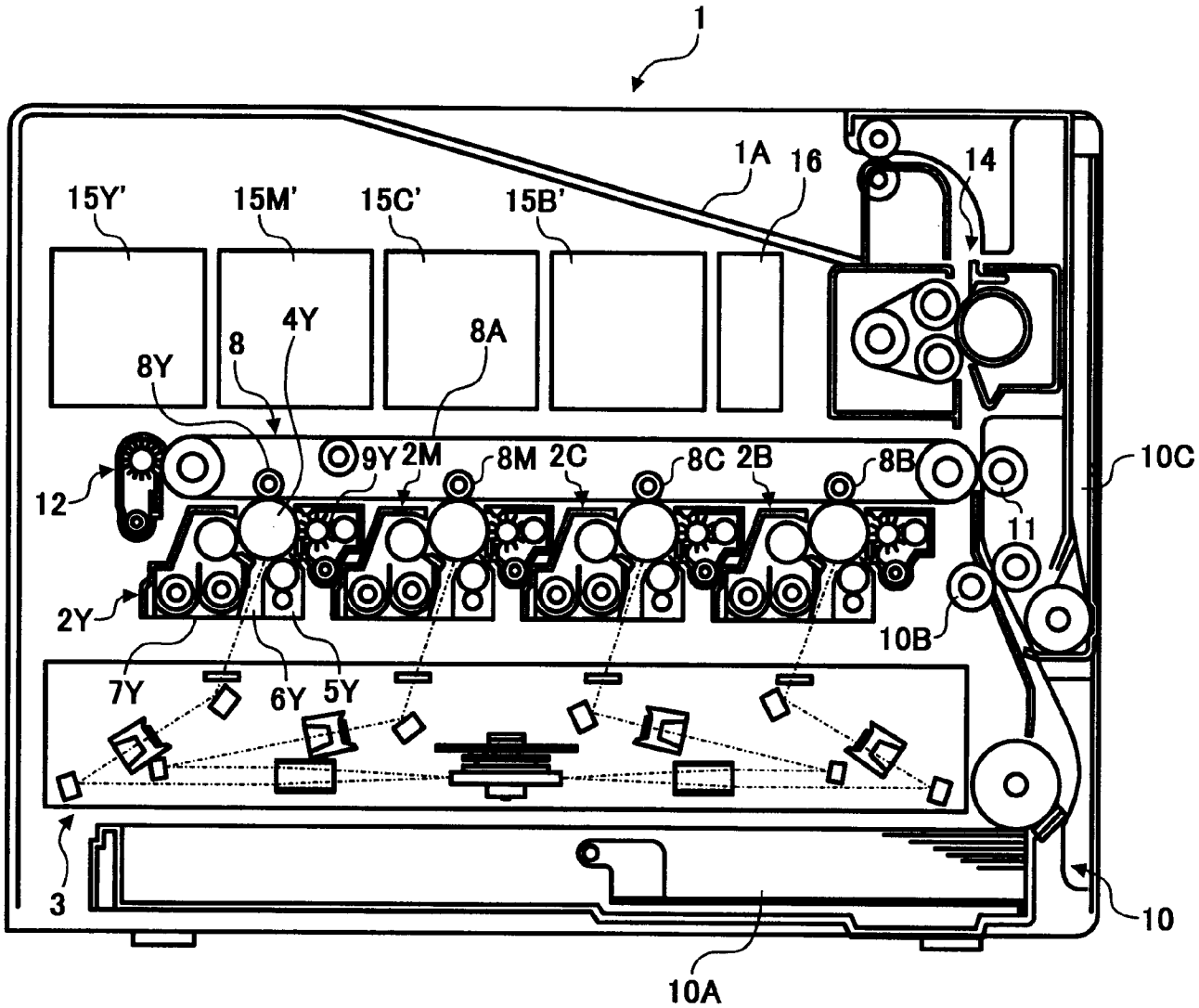
FIG. 11 shows an image forming apparatus to which a third embodiment of the developing device in accordance with the present invention is applied.

As shown in FIG. 11, tonerreplenishing sections 15Y', 15M', 15C' and 15B' for effecting trickle development and a single carrier replenishing section 16 are arranged above the image forming units 2Y through 2B. The toner replenishing sections 15Y' through 15B' share the carrier replenishing section 16.

Figure 12:
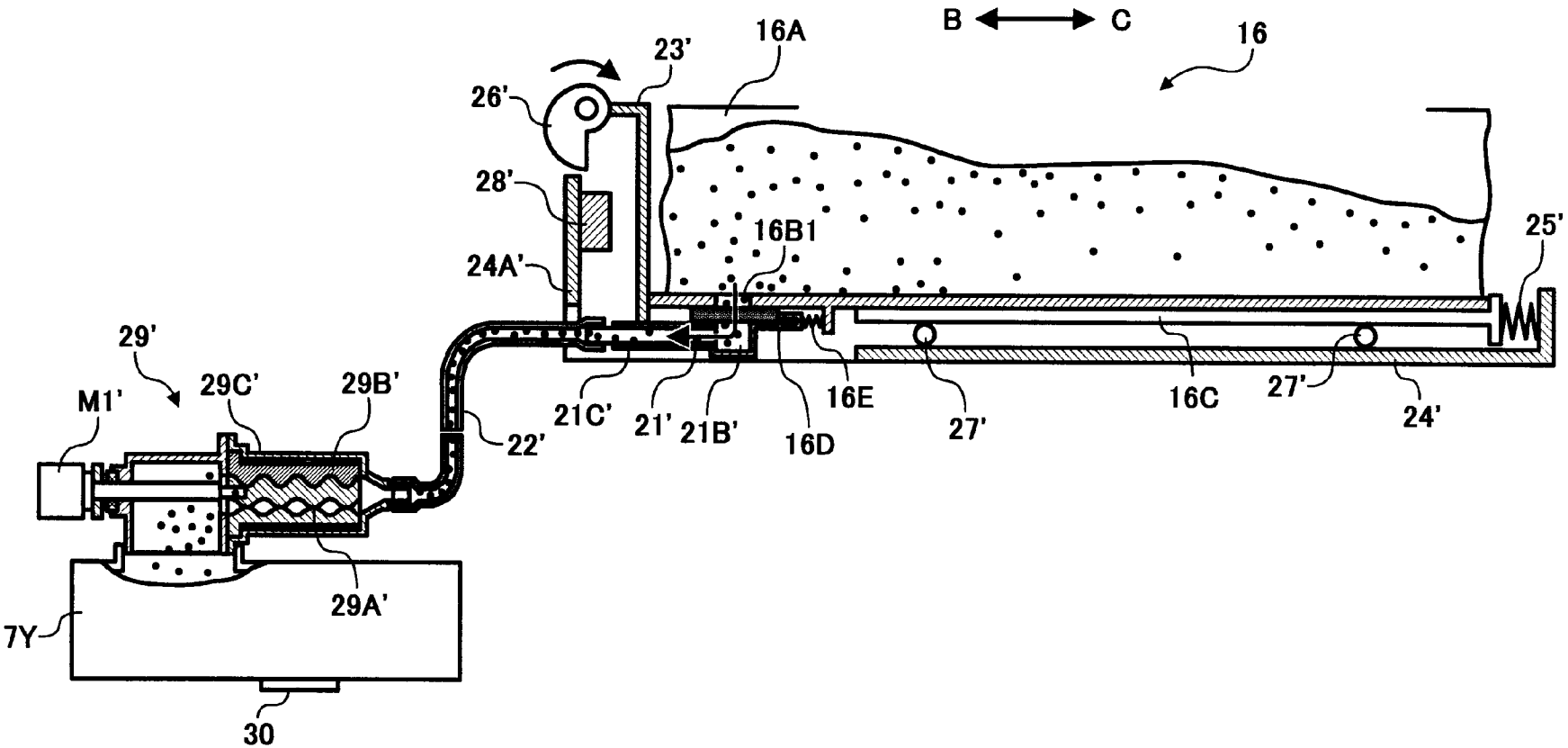
FIG. 12 shows a carrier replenishing section included in the third embodiment specifically.
Figure 13:
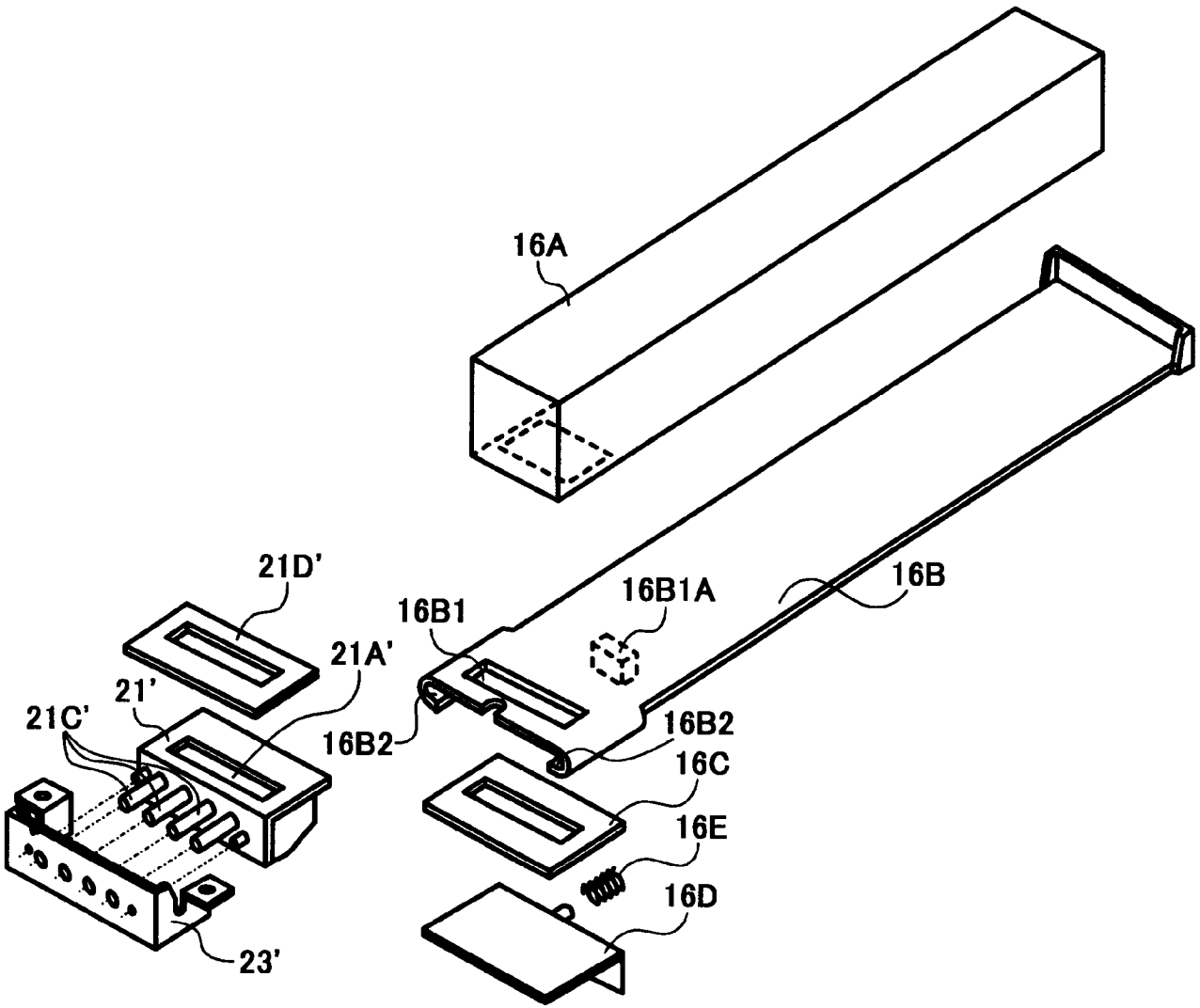
FIG. 13 is a fragmentary perspective view of the carrier replenishing section.

FIGS. 12 and 13 show the carrier replenishing section 16 specifically. As shown, the carrier replenishing section 16 is identical with the developer replenishing section of FIGS. 2 and 3 except for the following. The carrier replenishing section 16 includes a storing member or carrier container 16A and a bottom plate 16B. The storing member 16A is positioned on a structural body 16C identical in configuration with the structural body 15Y2 of the developer replenishing section 15Y.

The bottom of the storing member 16A and bottom plate 16B are formed with aligned outlets designated by 16B1 attached only to the outlet of the bottom plate 16B. The aligned outlets form part of a carrier delivering portion. A shutter 16D is positioned on the underside of the bottom plate 16B in alignment with the outlet 16B1 with the intermediary of a seal 16C. The shutter 16D, forming another part of the carrier delivering portion, corresponds to the cap or plug 18 of the developer replenishing section 15Y. The shutter 16D is therefore constantly biased by a resilient member 16E, which is positioned between the shutter 16D and the underside of the bottom plate 16B, in such a manner as to close the outlet 16B1. The shutter 16D opens the outlet 16B1 when a nozzle 21 is inserted into slide guides 16B2 formed on the underside of the bottom plate 16B.

As shown in FIG. 13, the top of the nozzle 21' to be inserted into the slide guides 16B1 is formed with a hole 21A' capable of being communicated to the outlet 16B1. A space below the hole 21A' is used as a carrier well 21B'. A plurality of nozzles 21C' each are communicated at one end to the carrier well 21B and communicable at the other end to a particular developing device via a tube 22'. The nozzle 21' is frictionally, hermetically engaged with the slide guides 16B2 of the bottom plate 16B via a seal 21D' and prevented from slipping out thereby.

The tube 22' connected to any one of the nozzles 21C' is communicated to a suction pump or carrier conveying means 29'. Because the suction pump 29 is identical with the suction pump 29 of the previous embodiments, its structural elements are simply distinguished from the structural elements of the suction pump 29 by dashes attached to the reference numerals.

In the carrier replenishing section 16, a movable piece 23' is constructed integrally with the structural body 16C as in the developer replenishing section 15Y, moving the structural body 16C back and forth in accordance with the profile of a cam 26'. Again, a shock-absorbing member 28' is fitted on a shoulder 24A', which is included in a support bases 24', at a position facing the movable piece 23'.

When a sharp change in acceleration occurs in the structural body 16C on the basis of the relation between the movable piece 23' and the cam 26', an inertia force is generated in the carrier stored in the storing member 16A and causes the carrier to flow toward the outlet. The carrier flown out to the carrier well 21B' of the nozzle 21' is delivered to the developing device 7Y by the suction pressure of the suction pump 29'.

Figure 14:
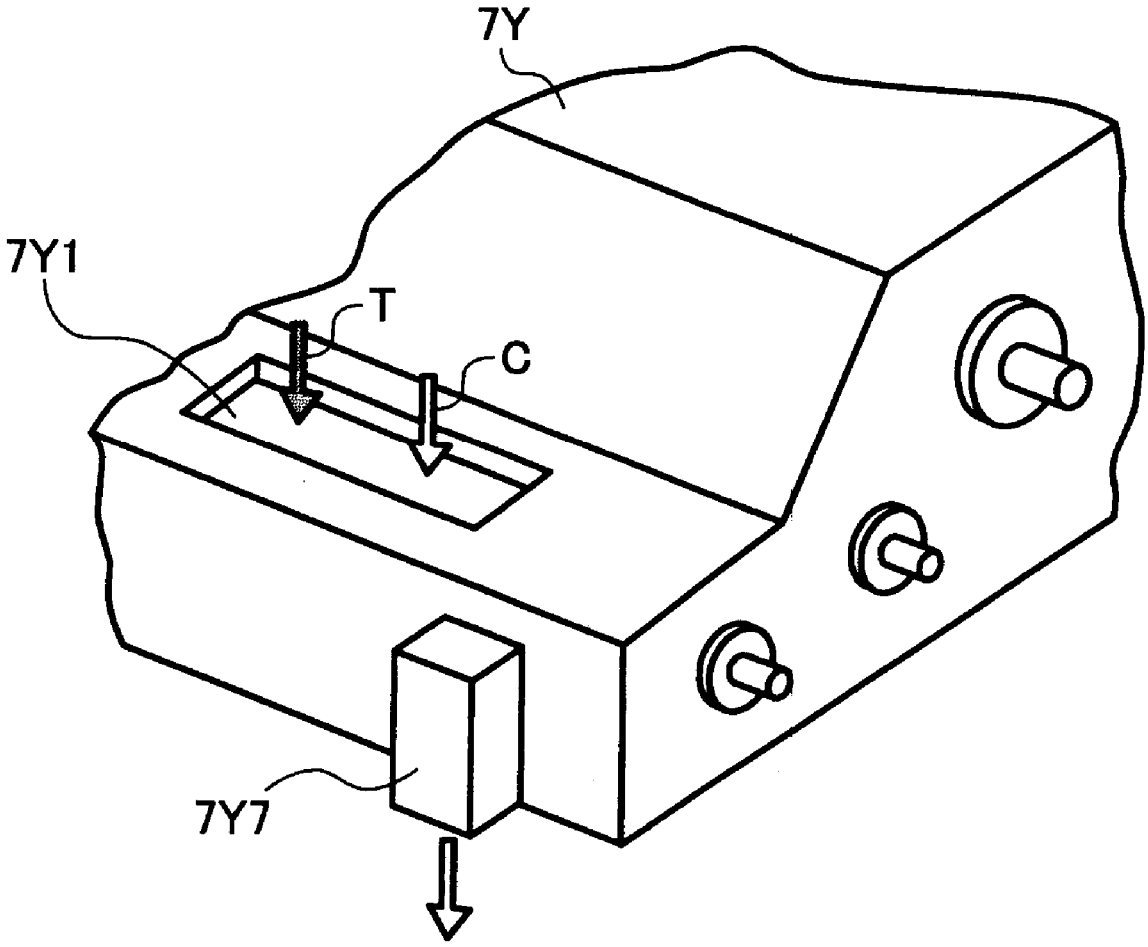
FIG. 14 is an external perspective view showing part of the third embodiment via which toner and carrier enter.

As shown in FIG. 14, the carrier, labeled C, thus replenished from the carrier replenishing section is introduced into the developing device 7Y via an inlet 7Y1 formed in the top of the case included in the developing device 7Y.

In each toner replenishing section and carrier replenishing section, a suction force is intermittently generated because the rotor and stator of the suction pump 29 or 29' mesh in different phases. The structural body 15Y2 or 16B is caused to move back and forth in synchronism with the generation of the suction force in the toner or the carrier replenishing section, so that toner, labeled T, or carrier C is delivered from the storing member 15Y1 or 16A when the suction force acts in the tube 22 or 22'. It follows that when the outlet of the storing member 15Y1 or 16A is opened, only the toner or the carrier is introduced into the tube 22 without any outside air mixed therewith. Outside air would vary the amount of delivery of toner or that of carrier.

When the carrier replenishing section is shared by a plurality of toner replenishing sections, a particular opening/closing member may be assigned to each nozzle in order to control replenishment in accordance with color-by-color toner content or carrier deterioration.

How the illustrative embodiment, using the trickle development system, controls the replacement of a developer will be described hereinafter. It is a common practice with the trickle development system to replenish toner in accordance with the varying toner content of a developer and to replenish a carrier by an amount corresponding to the amount of toner replenished. By so replenishing a carrier, it is possible to quicken the replacement of a developer. However, even when the carrier of the developer is not deteriorated to a degree needing replacement, the carrier is replaced with a fresh carrier, resulting in an increase in maintenance cost. In light of this, the illustrative embodiment replenishes a carrier by estimating a time corresponding to the actual life of the carrier, as will be described hereinafter.

Figure 15:
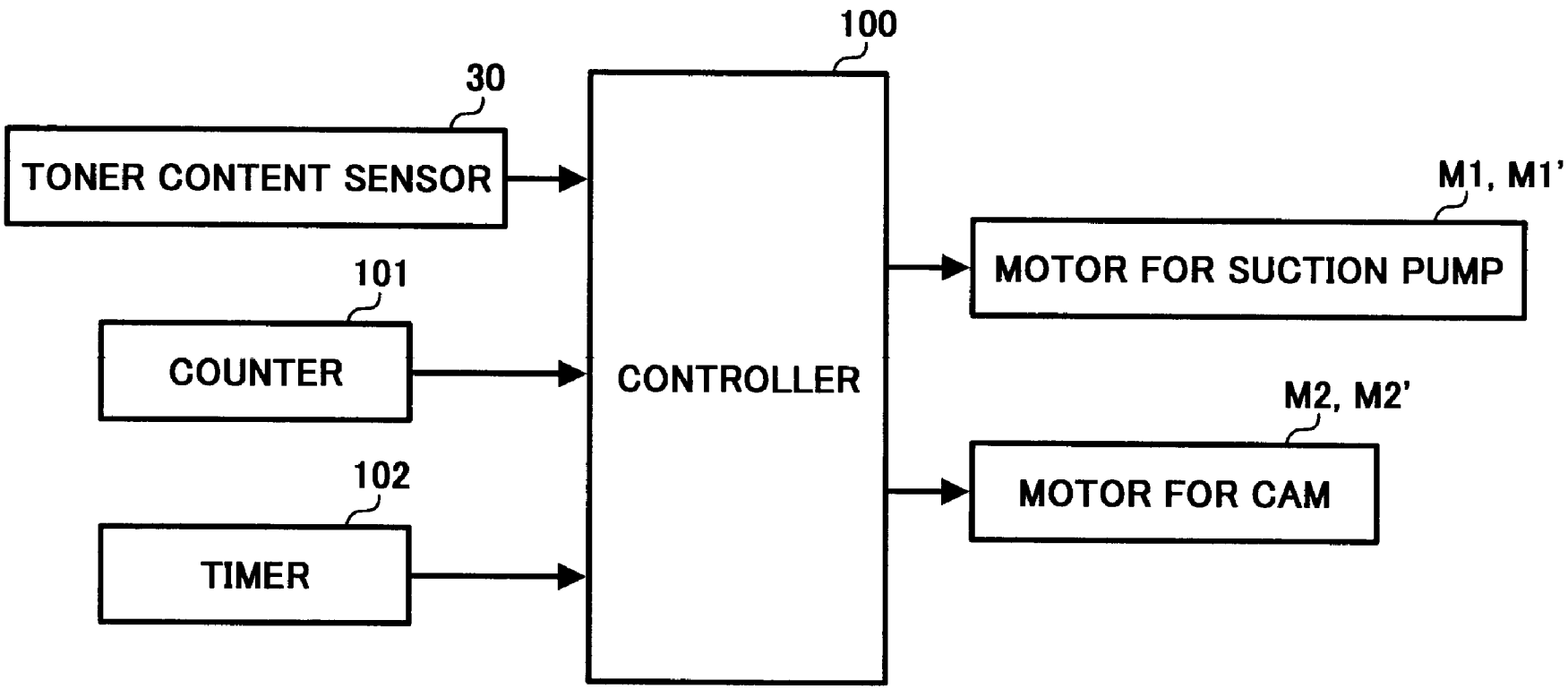
FIG. 15 is a block diagram schematically showing a control system included the third embodiment.

FIG. 15 shows a control system for controlling the replenishment of toner and carrier in the trickle development system and including a controller 100. Toner content sensors (represented by the sensor 30, FIG. 4) included in the developing devices of different colors, acounter 101 for counting printing/copying cycles effected and a timer 102 for counting the drive time of a drive member included in each developing device are connected to the input side of the controller 100. The motors M1 and M1' assigned to the suction pumps 29 and 29', respectively, and motors M2 and M2' assigned to the cams M2 and M2', respectively, are connected to the output side of the controller 100.

The controller 100 is capable of estimating an amount of toner replenished on the basis of the variation of toner content sensed by the sensor 30 and on the basis of the amount of toner consumed. The amount of toner consumed is determined by using an image area and image density selected.

Also, the controller 100 estimates an amount of carrier capable of correcting the toner content to a preselected value in accordance with the amount of toner replenished and estimates an amount of carrier to be replenished in consideration of a period of time over which a carrier stayed in a developing device. Because the above period of time is a factor that influences the deterioration of a carrier, an amount of carrier to be replenished is set by comparing the number of times of printing/copying cycle effected and the duration of drive for development with preselected values. For example, the controller 100 increases the amount of carrier to be replaced as the above period of time increases. Alternatively, if the fatigue and life of the carrier can be directly sensed, then the above period of time may be replaced with the charging characteristics of toner and carrier for determining the degree of deterioration.

Figure 16:
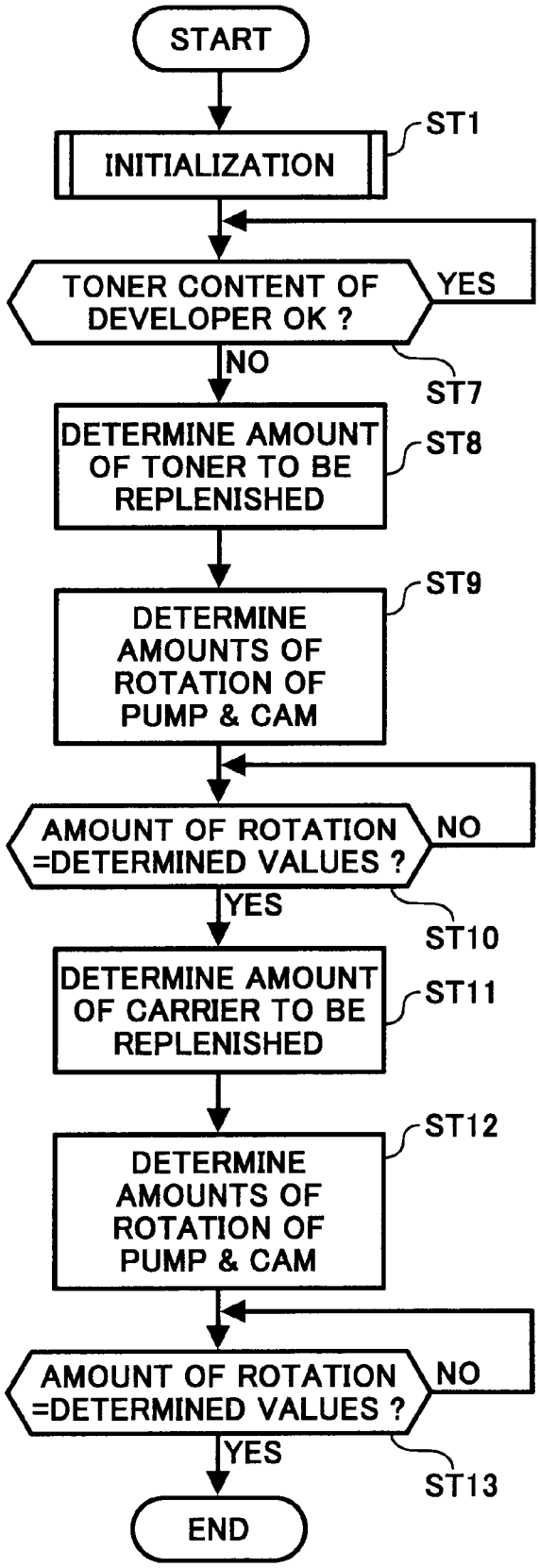
FIG. 16 is a flowchart demonstrating a main routine particular to the third embodiment.
Figure 17:
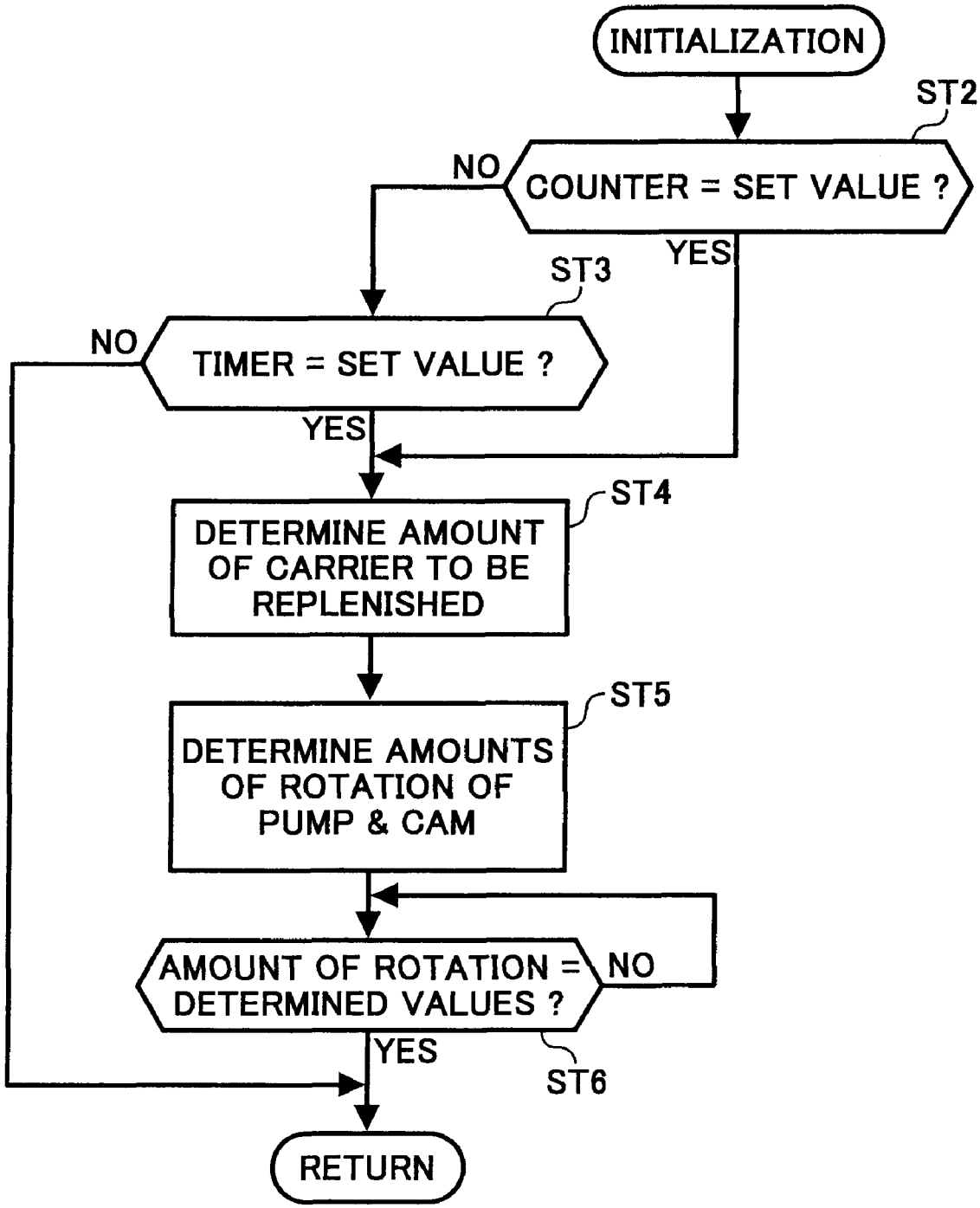
FIG. 17 is a flowchart showing a subroutine included in the main routine of FIG. 17.

FIG. 16 demonstrates a specific operation of the controller 100. As shown, on the start of image formation, the controller 100 executes initialization (step ST1). FIG. 17 shows the initialization in detail. As shown in FIG. 17, the controller 100 determines whether or not the total number of times of printing/copying effected and the total drive time of the developing device at the time of start each are coincident with a preselected value (steps ST2 and ST3). If the answer of the step ST2 or that of the step ST3 is positive (YES), then the controller 200 determines an amount of carrier to be replenished (step ST4) and then determines amounts by which the motors M1' and M2' should be driven (step ST5). Subsequently, the controller 100 sends drive signals to the motors M1' and M2' while monitoring the amounts of rotation via, e.g., encoders (step ST6). For initialization, stepwise values may be set beforehand, in which case the amount of replenishment will also be determined stepwise.

As shown in FIG. 16, If the condition for carrier replenishment is not satisfied during initialization, then the controller 100 monitors the toner content of the developer during image formation (step ST7). If the toner content is lower than a preselected value (NO, step ST7), then the controller 100 determines an amount of toner to be replenished that can provide the developer with the preselected toner content (step ST8). Subsequently, the controller 100 determines an amount by which the motor M1 and cam 26 should be driven (step ST19) and monitors their rotation (step ST10) . The controller 100 then determines an amount of carrier to be replenished in accordance with the amount of toner replenished (step ST11), determines the amounts of rotation of the motors M1' and M2' (step ST12), and monitors the rotation (step ST13).

The storing member included in the toner or the carrier replenishing section should be replaced when run out of toner or carrier, respectively. The replacement of the storing member can be effected by the user because the storing member has been folded up. Also, the toner or the carrier outlet formed in the bottom of the storing member allows toner or carrier, respectively, to easily fall due to gravity. This, coupled with the suction pressure, makes the amount of toner or that of carrier left in the storing member extremely small. In addition, the flexible storing section occupies a far smaller space than, e.g., a hard bottle when, e.g., stacked in the apparatus in the collapsed position, preventing the apparatus from being increased in size.

The nozzle, particularly one included in the toner replenishing section, can be easily communicated to the suction pump only if engaged with the outlet member mounted on the relatively rigid bottom plate included in the storing member. This allows the user to replace the storing member. In addition, because the outlet is formed in the bottom of the storing member, as stated above, the contraction of the storing member is free from obstruction that may occur if the outlet is formed in, e.g., one side of the storing member. This is also successful to educe the amount of toner or that of carrier to be left in the storing member.

When the storing member is mounted to the structural body, the direction in which the storing member is guided is coincident with the direction in which the nozzle is inserted. It is therefore possible to insert the nozzle while mounting the storing member to the structural body without resorting to a lever or similar special mounting structure. Further, by reducing the diameter of the nozzle, it is possible to reduce the size of the nozzle and increase the discharge pressure of the nozzle.

The suction pump for conveying the toner or the carrier is connected to the storing member by the tube, so that the toner or the carrier is prevented from flying about. Further, the replenishing section is subject to a minimum of limitation as to location, preventing the overall size of the apparatus from increasing.

As stated above, in the illustrative embodiment, the carrier can be replenished in accordance with the number of images formed or the duration of drive independently of replenishment control based on the amount of toner replenished. It is therefore possible to replace the carrier by determining the life of the carrier in terms of the number of times of image formation repeated or the duration of drive time for development. It follows that the life of the carrier is matched to the actual condition on the basis of a period of time over which the carrier has stayed in the developing device. This prevents the charging ability of the toner from falling due to the deterioration of the carrier to thereby obviation the variation of image density.

The storing member for the toner or the carrier replenishing section is implemented as a contractible flexible bag that decreases in volume in accordance with the consumption of the toner or that of the carrier. The storing member can therefore be efficiently collected when run out of the toner or the carrier, thereby preventing collection cost from increasing. Further, an inertia force generated when the structural body loaded with the storing member moves back and forth causes the toner or the carrier to move in one direction. The toner or the carrier can therefore be conveyed with high fluidity without cohesion by a simple procedure.

The toner or the carrier is conveyed from the storing member by the suction pressure of the conveying means, so that the storing member can be easily folded up and collected. In addition, the direction of conveyance is limited to prevent the toner or the carrier from flying about during replenishment.

The carrier replenishing section shared by a plurality of toner replenishing sections frees the apparatus from a bulky, sophisticated configuration.

Various modifications will become possible for those skilled in the art after receiving the teachings of the present disclosure without departing from the scope thereof.

What is claimed is:

1. A toner container, comprising:

a vessel configured to store toner;

a receiver configured to receive toner from the vessel, the receiver having a passage for passing toner received from the vessel in a downward vertical direction to an outlet of the receiver for delivering the toner therefrom;

a tubular portion provided below the outlet of the receiver and oriented in a horizontal direction; and a plug having a circular cross-section disposed movably in the tubular portion for closing the outlet, wherein the tubular portion is configured to receive a horizontal nozzle of an image forming apparatus which allows the horizontal nozzle to be in communication with the outlet of the receiver.

2. The developer container as claimed in claim 1, wherein the receiver comprises a funnel-like bottom formed with the outlet.

3. The toner container as claimed in claim 1, wherein the plug is configured to close the outlet with a resilient member.

4. The toner container as claimed in claim 1, wherein the nozzle of the image forming apparatus is connected to a suction pump.

5. The toner container as claimed in claim 1, wherein the vessel is configured to store developer which is a two-ingredient type developer including the toner and carrier.

6. An image forming apparatus having a toner container, the toner container comprising:

a vessel storing toner;

a receiver configured to receive toner from the vessel, the receiver having a passage for passing toner received from the vessel in a downward vertical direction to an outlet for delivering the toner therefrom;

a tubular portion provided below the outlet of the receiver and oriented in a horizontal direction; and a plug having a circular cross-section disposed movably in the tubular portion for closing the outlet, wherein when a horizontal nozzle of the image forming apparatus is inserted into the tubular portion, the nozzle is in communication with the outlet of the receiver.

7. The image forming apparatus as claimed in claim 6, wherein the vessel stores a two-ingredient type developer which includes the toner and carrier.

8. The image forming apparatus as claimed in claim 6, wherein the image forming apparatus further comprises:

a developing device configured to discharge an excess developer to an outside of the developing device.

9. The toner container as claimed in claim 1, wherein: the vessel is rectangular.

10. The toner container as claimed in claim 1, wherein: the receiver is attached to an underside of the vessel.

11. The toner container as claimed in claim 1, wherein: the vessel is fixed in position, relative to the receiver.

12. The toner container as claimed in claim 1, wherein: the tubular portion is below a bottom of the vessel.

13. The toner container as claimed in claim 1, wherein: the tubular portion has one end thereof which is closed.

14. A toner container, comprising:

a vessel having an elongated configuration and configured to store toner;

a receiver configured to receive toner from the vessel, the receiver having a passage for passing toner received from the vessel in a downward vertical direction to an outlet for delivering the toner therefrom;

a tubular portion provided below the outlet of the receiver and oriented in a horizontal direction; and a plug having a circular cross-section disposed movable in the tubular portion for closing the outlet, wherein the tubular portion is configured to receive a horizontal nozzle of an image forming apparatus which allows the horizontally nozzle to be in communication with the outlet of the receiver, the vessel is arranged to be parallel to a direction in which the nozzle is inserted into the tubular portion, and the receiver is attached in the vicinity of one end portion of the vessel.

15. The toner container as claimed in claim 14, wherein the receiver comprises a funnel-like bottom formed with the outlet.

16. The toner container as claimed in claim 14, wherein the plug is configured to close the outlet with a resilient member.

17. The toner container as claimed in claim 14, wherein the nozzle of the image forming apparatus is connected to a suction pump.

18. The toner container as claimed in claim 14, wherein the vessel stores developer which is a two-ingredient type developer including the toner and carrier.

19. The toner container as claimed in claim 14, wherein the vessel is rectangular.

20. The toner container as claimed in claim 14, wherein the receiver is attached to an underside of the vessel.

21. The toner container as claimed in claim 14, wherein the vessel is fixed in position, relative to the receiver.

22. The toner container as claimed in claim 14, wherein the tubular portion is below a bottom of the vessel.

23. The toner container as claimed in claim 14, wherein the tubular portion has one end thereof which is closed.

24. The toner container as claimed in claim 14, wherein the vessel is implemented by one or more flexible sheets.

25. The toner container as claimed in claim 14, wherein the vessel is non-rotatably mounted on the image forming apparatus.

26. The toner container as claimed in claim 1, wherein the vessel has a length which is parallel to a direction in the nozzle is inserted into the tubular portion.

27. The image forming apparatus as claimed in claim 6, wherein the vessel has a length which is parallel to a direction in the nozzle is inserted into the tubular portion.

28. The toner container as claimed in claim 14, wherein the vessel has a length which is parallel to a direction in the nozzle is inserted into the tubular portion.

* * * * *